US006696672B2

(12) United States Patent
Ke et al.

(10) Patent No.: US 6,696,672 B2
(45) Date of Patent: Feb. 24, 2004

(54) HEATING LAMP BRACKETS FOR REACTION CHAMBERS OF EVAPORATION COATING MACHINES

(75) Inventors: Hung-Lin Ke, Hsinchu (TW); Hua-Jen Tseng, Hsinchu (TW); Chun-Chieh Lee, Hsinchu (TW); Muh-Lang Jang, Miaoli (TW)

(73) Assignee: Mosel Vitelic Inc. (TW)

( * ) Notice: Subject to any disclaimer, the term of this patent is extended or adjusted under 35 U.S.C. 154(b) by 125 days.

(21) Appl. No.: 10/029,930

(22) Filed: Dec. 31, 2001

(65) Prior Publication Data

US 2002/0084391 A1 Jul. 4, 2002

(30) Foreign Application Priority Data

Jan. 3, 2001 (TW) ..... 90200092 U

(51) Int. Cl.[7] ..... F27D 11/02; F27B 5/14; H05B 3/66

(52) U.S. Cl. ..... 219/411; 219/526; 219/537; 392/411; 362/225

(58) Field of Search ..... 219/390, 411, 219/526, 536, 537; 392/411, 416; 118/50.1, 725; 362/217, 225

(56) References Cited

U.S. PATENT DOCUMENTS 3,596,057 A * 7/1971 Arntz et al. ..... 219/411
5,335,310 A * 8/1994 Novy et al. ..... 219/537
5,748,837 A * 5/1998 Lokar et al. ..... 392/411
6,465,761 B2 * 10/2002 Stevens et al. ..... 219/411

FOREIGN PATENT DOCUMENTS

WO 9109673 * 7/1991

* cited by examiner

*Primary Examiner*—Joseph Pelham
(74) *Attorney, Agent, or Firm*—Bacon & Thomas, PLLC

(57) ABSTRACT

A heating lamp bracket for reaction chambers of evaporation coating machines. The heating lamp bracket uses paired and insulation devices to mount heating lamps to a chamber wall of a reaction chamber. The bracket includes a mounting frame that has an insulation outer surface and a mounting outer face opposing to the insulation outer surface. The insulation outer surface has at least one insulation member located thereon for fastening the mounting frame to the chamber wall. The mounting outer surface has at least two independent mounting spots for connecting respectively a connection end of the corresponding heating lamp. The independent mounting spots and non-encased type insulation members of the present invention allows for the replacement of the heating lamps and defective insulation.

14 Claims, 2 Drawing Sheets

HEATING LAMP BRACKETS FOR REACTION CHAMBERS OF EVAPORATION COATING MACHINES

BACKGROUND OF THE INVENTION (1) Field of the Invention

The present invention relates to heating lamp brackets for use in the reaction chambers of evaporation coating machines and more particularly to the chamber brackets that are easy to be installed and that allow individual replacement of the heating lamps.

(2) Description of the Prior Art

In the reaction chambers of an electronic evaporation coating machine (or coater), the heating lamp sets are mounted in the reaction chambers to maintain the interior temperature of the reaction chambers at a normal reaction temperature of about 240 degrees Celsius to prevent the metal source for ionization from cooling and condensing, and avoid affecting the evenness of the film during coating processes.

FIG. 1 illustrates a conventional heating lamp set mounted in a reaction chamber of an evaporation coater. In general, a reaction chamber (corresponding to one electronic gun) has three sets of heating lamp brackets. Each bracket set has a pair of brackets 2 for mounting three pieces of heating lamps 4 as shown in the drawing. Each bracket 2 is mounted to the chamber wall 1 of the reaction chamber through an insulation member 21. Three heating lamps 4 have corresponding ends thereof disposed in the lamps seats 232 of a mounting frame 23 and are clamped by a hatch plated 24. Electric power for the heating lamps 4 is supplied through a power cord 3 which runs through a power inlet opening 231 formed in the mounting frame 23.

Generally, the mounting of heating lamps set forth above has following disadvantages:

1. The insulation member 21 serving as the medium between the bracket 2 and the chamber wall 1 has one end fixed on the chamber wall 1 and another end inserted into a fasten sleeve 22 extended from the mounting frame 23 and fastened by two set screws 221 through the fasten sleeve 22. The set screws 221 for fastening the insulation member 121 and the fasten sleeve 22 are being installed separately. In practice, there are no reference or means to help positioning the setscrews at the exact locations. Hence, in the conventional bracket 2, the fastening between the insulation member 21 and the fasten sleeve 22 is difficult and often leads to dislocation of the heating lamps 4. As a result, ill effect upon heating and thus coating is inevitable.
2. In the conventional bracket 2, the three sets of heating lamps 4 are fastened to the mounting frame 23 by clamping one end of the heating lamps 4 by a hatch plate 24, and the hatch plate 24 is fastened to the mounting frame 23 by two hatch screws 25 passing through the corresponding hatch screw bores 241 formed in the hatch plate 24 to engage with the corresponding screw bores (not shown in the drawing) formed in the mounting frame 23. In the event that one of the heating lamps 4 is malfunction, the hatch plate 24 has to be disassembled and removed for replacement of the damaged heating lamp 4. The disassembling and removing of the hatch plate 24 obviously affects three lamps 24. Therefore, repairs and maintenance work may be enhanced, and also the possibility of component damage may be increased.
3. The insulation member 21 is usually fastened to the fasten sleeve 22 by means of vertical set screws 221 which will push one side of the insulation member 21 to contact with the interior wall of the fasten sleeve 22. In the coating process, the upper rim (i.e. the area close to the chamber wall 1) of the contact area tends to accumulate a metal residue. As the insulation member is mounted in an encased type and has a slim insulation interval (i.e. the gap between the fasten sleeve 22 and chamber wall 1), the formation of the metal residue tends to cause a short circuit between the heating lamps and the chamber wall 1. As a result, the utilization and uptime of the chamber will be impacted directly.

Furthermore, in the operation of the conventional evaporation coaters, the repairs and maintenance procedures of the reaction chambers require cooling, de-vacuumizing and air blowing before replacing of the heating lamps 4 in the insulation member 21 can be begun. It is apparently that any repair and maintenance work will affect the production of evaporation coating. Thus, improving the mounting brackets of the heating lamps to reduce the repairs and maintenance frequency is an important issue to increase the equipment utilization rate.

SUMMARY OF THE INVENTION

The primary object of the invention to provide a heating lamp bracket for reaction chambers of evaporation coating machines that has independent bracket mounting spots and a non-encased type insulation member fastening structure for effectively resolving the problems of operation difficulty for replacing heating lamps and defective insulation that happen to the conventional structures.

The heating lamp bracket of the present invention is to mount a plurality of heating lamps in a paired and insulated fashion to the chamber wall of the reaction chambers of an evaporation coating machine or the like for keeping the reaction chambers at a constant reaction temperature. The bracket is to clamp a connection end located at one side of the heating lamps, and includes a mounting frame that has an insulation outer surface and a mounting outer surface opposite to the insulation outer surface. The insulation outer surface is to mount at least one insulation member that is to fasten the mounting frame to the chamber wall. The mounting outer surface provides at least two independent mounting spots for connecting independently the corresponding connection ends of the heating lamps.

In one embodiment of the invention, the mounting spots on mounting outer surface of the mounting frame for fastening the connection ends of the corresponding heating lamps can be embodied as mounting screw bores formed in the mounting frame and mounting screws for matching with the mounting screw bores. The connection ends of the heating lamps can then be fastened between the mounting screw bores and the mounting screws.

In another embodiment, the mounting spot may include a mounting screw bolt extended from the mounting frame and a mounting screw nut for matching with the mounting screw bolt. The connection end of the heating lamp can then be fastened between the mounting screw bolt and the mounting screw nut.

In the preferable embodiment of the invention, the mounting frame may include two insulation members, and each of them has an insulation screw bore to allow a fasten screw to fasten the insulation member onto the corresponding insulation outer surface of the mounting frame. The two insulation members form a linear mounting fashion and may fasten the mounting frame securely to the chamber wall of the reaction chamber. The height of the insulation members is the spacing between the insulation outer surface of the mounting frame and the chamber wall. Such a structure can improve the shortcomings caused by the small insulation gap that happens to the conventional encased type insulation members.

According to another embodiment of the invention, a fasten space is provided between the insulation outer surface and the mounting outer surface of the mounting frame to facilitate tightening or loosening of the fasten screws in the insulation screw bores. A through aperture is formed to connect the insulation outer surface and the fasten space for establishing the engaging of the insulation screw bore and the fasten screw.

The foregoing, as well as additional objects, features and advantages of the invention will be more readily apparent from the following detailed description, which proceeds with reference to the accompanying drawings.

DESCRIPTION OF THE PREFERRED EMBODIMENT

The invention disclosed herein is directed to heating lamp brackets for reaction chamber of evaporation coating machines. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
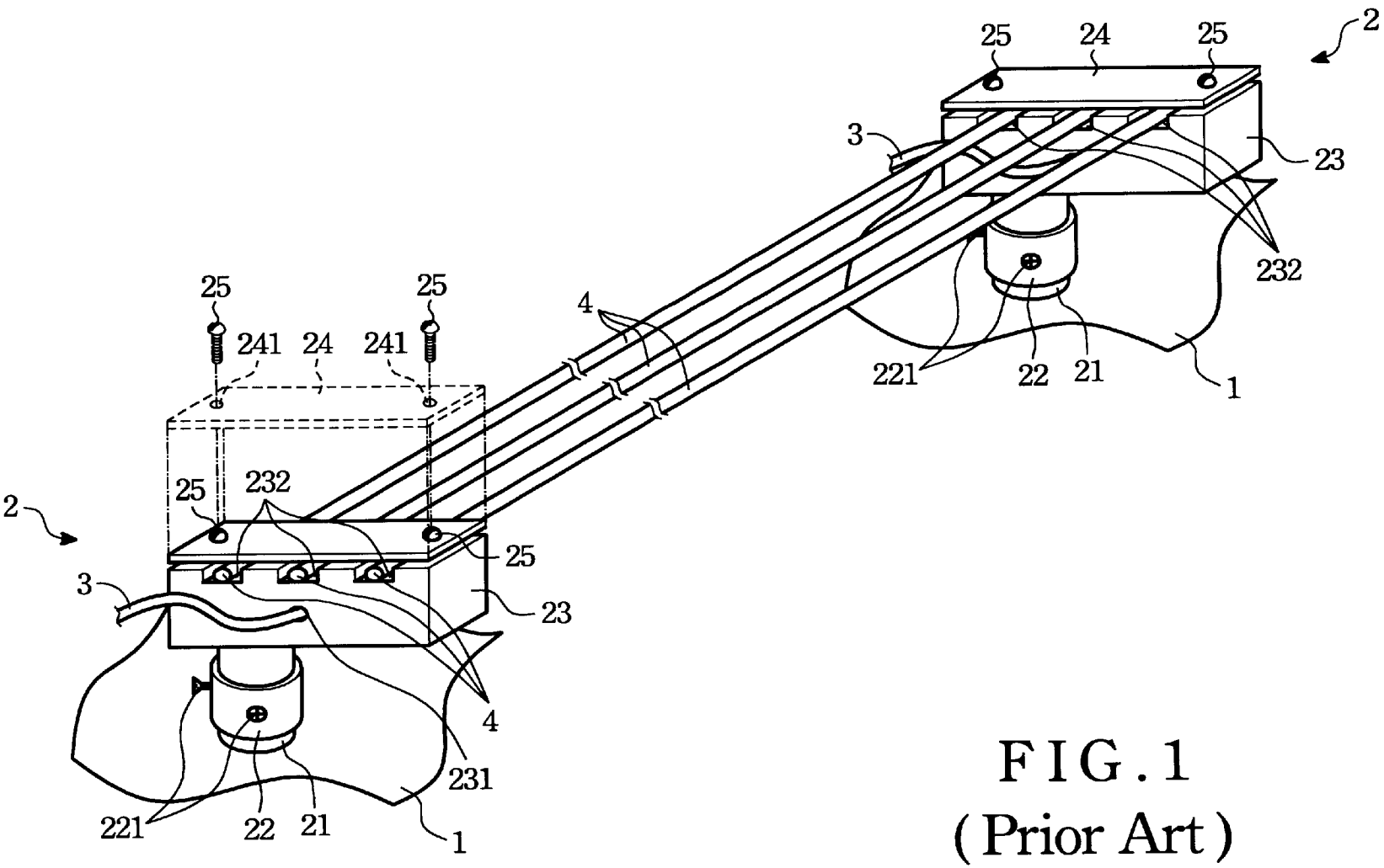
FIG. 1 (Prior Art)
FIG. 1 a schematic perspective view of a conventional heating lamp bracket mounting in a reaction chamber of an evaporation coating machine.
Figure 2:
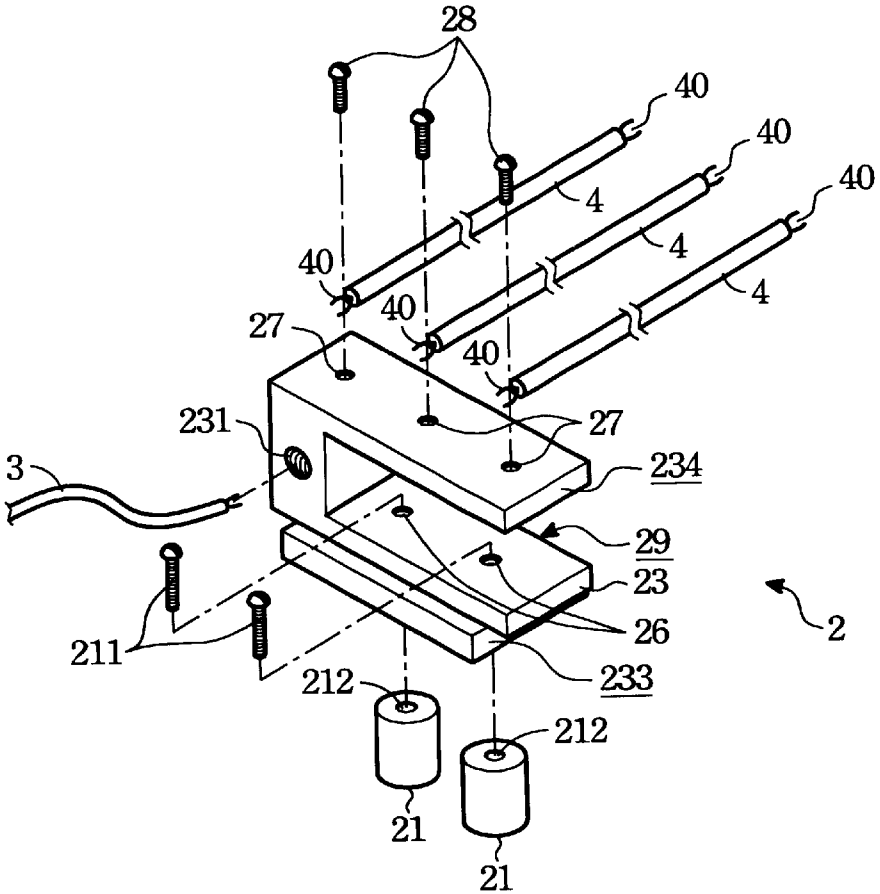
FIG. 2 is a fragmentary perspective view of a heating lamp bracket of an embodiment of the invention, with matching heating lamps.

Referring now to FIG. 2 for an embodiment of the present invention, the heating lamp bracket 2 for reaction chambers of evaporation coating machines is paired and insulated like a conventional one shown in FIG. 1 for mounting a plurality of heating lamps 4 to the chamber wall of the reaction chambers of an evaporation coating machine or the like for maintaining the reaction chamber at a constant reaction temperature by the heating lamps 4.

As shown in FIG. 2, the heating lamp set includes three heating lamps 4, and each of them has two connection ends 40 located at two opposing ends thereof for connecting with respective mounting brackets 2.

The bracket 2 is mainly to clamp the connection ends 40 of the heating lamps 4, and includes a mounting frame 23 that has an insulation outer surface 233 and a mounting outer surface 234 opposite to the insulation outer surface 233. The insulation outer surface 233 can mount thereon at least one insulation member 21 for fastening the mounting frame 23 to a chamber wall (not shown in the drawing, but referring to FIG. 1). The mounting outer surface 234 can provide at least two independent mounting spots (shown three independent mounting spots in FIG. 2) for connecting respectively and independently the heating lamps 4 at the corresponding connection ends 40.

Figure 3:
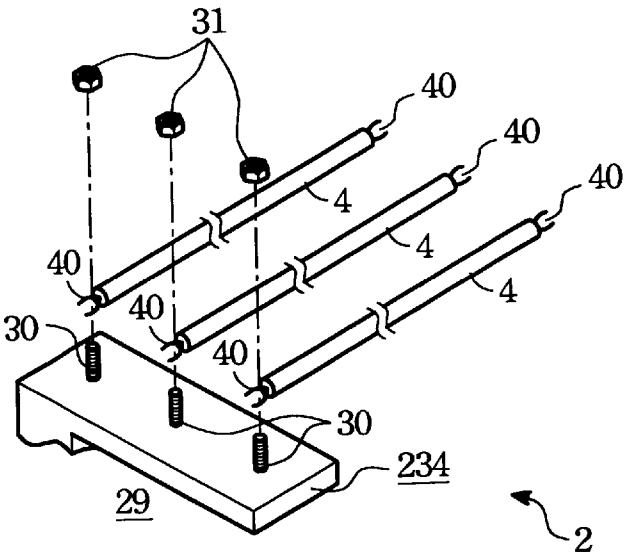
FIG. 3 is a fragmentary perspective view of a heating lamp bracket of another embodiment of the invention.

The mounting spots on the mounting outer surface 234 are used to fasten the corresponding connection ends 40 of the heating lamps 4. The mounting spots in this shown embodiment are embodied as mounting screw bores 27 formed in the mounting frame 23 and respective mounting screws 28 for matching with the mounting screw bores 27. When in use, the connection ends 40 of the heating lamps 4 can be fastened in between by the mounting screw bores 27 and the respective mounting screws 28. In another embodiment shown in FIG. 3, the mounting spots can be embodied as mounting screw bolts 30 fastened to the mounting outer surface 234 of the mounting frame 23 in a protrusive manner and respective mounting screw nuts 31 for matching with the mounting screw bolts 30. Similarly, when in use, the connection ends 40 of the heating lamps 4 are fastened in between by the mounting screw bolts 30 and the respective mounting screw nuts 31.

As shown in FIG. 2, the mounting frame 23 includes two insulation members 21, and each of them has an insulation screw bore 212 for engaging with a fasten screw 211 for fastening the insulation member 21 to the corresponding insulation outer surface 233 of the mounting frame 23. The linear type fastening formed by the two insulation members 21 can fasten the mounting frame 23 securely to the chamber wall of the reaction chambers. The height of the insulation members 21 is the spacing between the insulation outer surface 233 of the mounting frame 23 and the chamber wall. Such a construction resolves the problem of too small insulation interval that happens to the conventional encased type insulation member (consists of a fasten sleeve 22, as shown in FIG. 1).

As shown in FIG. 2, there is a fasten space 29 formed between the insulation outer surface 233 and the mounting outer surface 234 of the mounting frame 23 for facilitating the tightening or loosening upon the fasten screws 211 in the insulation screw bores 212. There are through apertures 26 formed to connect the insulation outer surface 233 and the fasten space 29 for enabling the fasten screws 211 to engage with the insulation screw bores 212.

In the present invention, the mounting frame 23 can further have a power supply opening 231 for allowing an external power cord 3 to pass through. By providing the power cord 3, electric power can be transmitted to the heating lamps 4 mounted on the mounting frame 23.

According to the present invention, the independent mounting spots for mounting the heating lamps 4 can allow individual heating lamp 4 be removed or fastened for repairs or replacements whenever required, without moving other heating lamps 4 or mounting elements on the same heating lamp set. Hence, it effectively resolves the troublesome replacement problems that happen to the conventional heating lamp structure described above.

In the present invention, the mounting of the non-encased type insulation members 21 allows the height of the total insulation member 21 become the effective insulation spacing between the mounting frame 23 and chamber wall. It thus successfully overcomes the insulation defective problems resulting from too small insulation interval and accumulation of metal coating residues that happen to the conventional structures.

While the preferred embodiments of the invention have been set forth for purpose of disclosure, modifications of the disclosed embodiments of the invention as well as other embodiments thereof may occur to those skilled in the art (such as matching the screws and screw bores, or screw bolts and screw nuts, or other connection means). Accordingly, the appended claims are intended to cover all embodiments which do not depart from the spirit and scope of the invention.

What is claimed is:

1. A heating lamp bracket for a reaction chamber of an evaporation coating machine comprising:

a mounting frame having two opposing outer surfaces, one of the outer surfaces having at least one insulation member located thereon for fastening the mounting frame to a chamber wall of the reaction chamber, at least two independent mounting spots, and each of the mounting spots mounting directly to one end of a heating lamp; and wherein said mounting frame includes another insulation member, each of said insulation members having an insulation screw bore for engaging with a fasten screw to fasten said insulation member to said corresponding outer surface of said mounting frame.

2. The heating lamp bracket of claim 1, wherein said mounting spot includes a mounting screw bore formed in said mounting frame and a mounting screw for matching with the mounting screw bore.

3. The heating lamp bracket of claim 1, wherein said mounting spot includes a mounting screw bolt fastened to said mounting frame in a protrusive manner and a mounting screw nut for matching with the mounting screw bolt.

4. The heating lamp bracket of claim 1 wherein said two outer surfaces of said mounting frame further include a fasten spacing located therebetween for operating said fasten screw with said insulation screw bore, said fasten screw being engaged with said insulation screw bore through a through aperture formed thereof for connecting said insulation outer surface and the fasten spacing.

5. A heating lamp bracket for a reaction chamber of an evaporation coating machine, comprising a mounting frame which has an insulation outer surface and a mounting outer surface opposing to the insulation outer surface, the insulation outer surface having at least one insulation member for fastening the mounting frame to a chamber wall of the reaction chamber, and the mounting outer surface for fastening at least one heating lamp at one end thereof, characterized on that a spacing formed between the insulation outer surface and the chamber wall has a height equal to that of the insulation member.

6. The heating lamp bracket of claim 5, wherein said mounting frame includes another insulation member, each of said insulation members having an insulation screw bore for engaging with a fasten screw to fasten said insulation member to said corresponding outer surface of said mounting frame.

7. The heating lamp bracket of claim 6, wherein said insulation outer surface and said mounting outer surface of said mounting frame further include a fasten spacing located therebetween for operating said fasten screw with said insulation screw bore, said fasten screw being engaged with said insulation screw bore through a through aperture formed thereof between said insulation outer surface and said fasten space.

8. The heating lamp bracket of claim 5, wherein said mounting outer surface of said mounting frame includes at least two independent mounting spots, and each of the mounting spots being for mounting one said heating lamp.

9. The heating lamp bracket of claim 8 wherein said mounting spot includes a mounting screw bore formed in said mounting frame and a respective mounting screw for matching with the mounting screw bore.

10. The heating lamp bracket of claim 8, wherein said mounting spot includes a mounting screw bolt mounted to said mounting frame in a protrusive manner and a respective mounting screw nut for matching with the mounting screw bolt.

11. A heating lamp set for a reaction chamber of an evaporation coating machine, located on a chamber wall for maintaining the reaction chamber at a selected temperature, comprising:

at least two heating lamps, each of said heating lamps having two ends thereof for forming respectively as connection ends;

a pair of mounting brackets for holding the heating lamps therebetween, each the mounting bracket having an insulation outer surface and a mounting outer surface, the insulation outer surface having at least one insulation member for fastening the mounting frame to the chamber wall, the mounting outer surface having at least two mounting spots, and each of the mounting spots mounting a corresponding one of the connection ends of the heating lamp; and wherein said mounting frame further includes another insulation member, each of said insulation members having an insulation screw bore for engaging with a respective fasten screw to fasten said insulation member to said corresponding outer insulation surface of said mounting frame, a spacing formed to connect said insulation outer surface and said chamber wall having a height equal to another height of said insulation member.

12. The heating lamp set of claim 11, wherein said mounting spot includes a mounting screw bore formed in said mounting frame and a respective mounting screw for matching with the mounting screw bore.

13. The heating lamp set of claim 11, wherein said mounting spot includes a mounting screw bolt for fastened to said mounting frame in a protrusive manner and a respective mounting screw nut for matching with the mounting screw bolt.

14. The heating lamp bracket of claim 11, wherein said insulation outer surface and said mounting outer surface of said mounting frame further include a fasten spacing located therebetween for operating said fasten screw with said insulation screw bore, said fasten screw being engaged with said insulation screw bore through a through aperture formed to connect said insulation outer surface and said fasten spacing.

* * * * *